US005950401A

United States Patent [19]

Blohm et al.

[11] Patent Number: 5,950,401

[45] Date of Patent: Sep. 14, 1999

[54] METHOD OF PRODUCING A PRINTED PRODUCT HAVING A PACKAGED COMPACT DISK

[75] Inventors: Eric E. Blohm, West Allis; William T. Graushar, Wauwatosa, both of Wis.

[73] Assignee: Quad/Tech, Inc., Sussex, Wis.

[21] Appl. No.: 08/878,449

[22] Filed: Jun. 18, 1997

Related U.S. Application Data

[63] Continuation of application No. 08/581,443, Dec. 29, 1995, abandoned, and application No. 08/872,893, Jun. 11, 1997, Pat. No. 5,881,538.

[51] Int. Cl.[6] ..... B65B 11/10; B65B 61/26

[52] U.S. Cl. ..... 53/411; 53/460; 53/461; 53/254

[58] Field of Search ..... 53/411, 131.4, 53/131.2, 131.3, 460, 466, 465, 462, 461, 206, 254, 474, 472, 445

[56] References Cited

U.S. PATENT DOCUMENTS

| | | | |
|---|---|---|---|
| 2,165,195 | 7/1939 | Sawdon | 281/3 |
| 2,232,783 | 2/1941 | Hausheer . | |
| 2,276,282 | 3/1942 | Bindszus . | |
| 2,346,044 | 4/1944 | Nadeau . | |
| 2,737,764 | 3/1956 | Lewis | 53/9 |
| 3,022,613 | 2/1962 | Powers | 53/28 |
| 3,057,128 | 10/1962 | Gerhauser | 53/28 |
| 3,139,712 | 7/1964 | De Woskin | 53/33 |
| 3,560,025 | 2/1971 | Ostrander | 281/3 |
| 3,593,485 | 7/1971 | Stoval | 53/28 |
| 4,313,557 | 2/1982 | Foffel | 229/68 R |
| 4,492,306 | 1/1985 | Cooper et al. | 206/216 |
| 4,511,033 | 4/1985 | May | 206/216 |
| 4,549,658 | 10/1985 | Sfikas | 206/614 |
| 4,630,427 | 12/1986 | Harper et al. | 53/460 |
| 4,644,731 | 2/1987 | Zangheri | 53/411 |
| 4,663,915 | 5/1987 | Van Erden et al. | 53/450 |
| 4,685,277 | 8/1987 | Ilsemann | 53/254 X |
| 4,852,327 | 8/1989 | Kurkowski et al. | 53/254 X |
| 4,852,740 | 8/1989 | Sellar et al. | 206/444 |
| 4,905,452 | 3/1990 | Vogan | 53/412 |
| 4,988,124 | 1/1991 | Hudetz | 283/56 |
| 5,031,772 | 7/1991 | Woodriff | 206/444 |
| 5,050,792 | 9/1991 | Segall | 229/68 R |
| 5,285,620 | 2/1994 | Kaye et al. | 53/254 X |

FOREIGN PATENT DOCUMENTS

| | | |
|---|---|---|
| 0423734 | 4/1991 | European Pat. Off. . |
| 717138 | 6/1968 | France . |
| 2419225 | 10/1979 | France . |
| 2611965 | 9/1988 | France . |

OTHER PUBLICATIONS

Photocopy of Solar Press product. (No Date).

*Primary Examiner*—James F. Coan
*Attorney, Agent, or Firm*—Michael Best & Friedrich LLP

[57] ABSTRACT

A method of producing a printed product having a computer disk incorporated therein, including the steps of providing a sheet of material, placing personalized indicia onto either the disk or the sheet of material, depositing the disk onto the sheet of material, folding the sheet of material over the disk to produce a package, gathering the package with a signature to produce a book block, and binding the book block to produce a printed product. The placing step can include the step of printing or the step of adding a label to either the disk or the sheet of material. The depositing step can include the step of positioning the disk over the personalized indicia such that the disk covers the personalized indicia. The placing step can occur either before or after the depositing step.

25 Claims, 5 Drawing Sheets

METHOD OF PRODUCING A PRINTED PRODUCT HAVING A PACKAGED COMPACT DISK

REFERENCE TO RELATED APPLICATIONS

This is a continuing application of U.S. patent application Ser. No. 08/581,443, filed Dec. 29, 1995, now abandoned, and U.S. patent application Ser. No. 08/872,893, filed Jun. 11, 1997, now U.S. Pat. No. 5,881,538.

FIELD OF THE INVENTION

The present invention relates generally to the field of packaging and, more specifically, to the field of packaging computer disks (e.g., floppy disks, CD-ROMs, audio compact disks, etc.) in such a manner that the computer disks can be readily incorporated into a process for producing printed products.

BACKGROUND OF THE INVENTION

The printing industry has long recognized the need to have the ability to incorporate objects (i.e., other than standard signatures) into printed products (e.g., magazines). For example, it is known to attach empty envelopes, cologne samples and dehydrated food into a magazine. Customer demands and increased competition in the printing industry has led to the continued search for new objects that can be incorporated into printed products. Since each product is different in its size, shape and ability to withstand abuse, new products can require novel packaging techniques in order to ensure the product can survive the printing process and subsequent delivery to the consumer.

Due to the relatively recent surge in computer popularity, companies have begun using computer disks to convey information to potential customers. For example, some companies provide potential customers with computer disks that give textual and pictorial information about the company's products. In addition, computer disks can accompany an owners' manual to convey to the consumer information about the use of the product. The ability to store large amounts of information makes CD-ROMs particularly useful in conveying information to consumers for these purposes. However, sending the computer disks by direct mail can be cost prohibitive, thereby limiting the use of computer disks for this purpose. In addition, enclosing a computer disk with a product can require special packaging in order to avoid damage to the disk. A cheaper way of packaging and sending computer disks could significantly increase their use in advertising and for other purposes.

The printing industry has also recognized the need for flexibility in producing different versions of the same book to be mailed to users in the same geographical location, and the value of printing personalized messages (e.g. directed to a specific consumer or group of consumers) on each book. Ink jet printing is commonly used for producing such personalized messages on these types of books. In this regard, U.S. Pat. No. 5,100,116 discloses an apparatus that can print on the full page of signatures. The disclosed printing apparatus removes signatures from a stack and separates the signatures for printing. The signatures are subsequently fed to a collating conveyor where the signatures are gathered to form a book block.

SUMMARY OF THE INVENTION

One way of packaging and sending computer disks to consumers is to attach the computer disk to a printed publication, such as a magazine. In this manner, the computer disk could be sent at bulk rate magazine costs, which are significantly cheaper than direct mail costs. In addition, the disks can be targeted to the specific consumers that receive the particular publication. For example, a CD-ROM that advertises expensive luxury automobiles could be attached to an automotive magazine, or possibly to a magazine directed to wealthier individuals. Further, utilizing the present invention, computer disks can be attached directly to an owners' manual, thereby safely securing the computer disk in a printed publication (i.e., the owners' manual) and avoiding the need for extra packaging for the disk. The packaged disk can also be personalized with printed indicia (e.g., a person's name or access code) to further personalize the product.

The present invention provides a method of producing a printed product having a computer disk incorporated therein. The method includes the steps of providing a sheet of material, placing personalized indicia onto either the disk or the sheet of material, depositing the disk onto the sheet of material, folding the sheet of material over the disk to produce a package, gathering the package with a signature to produce a book block, and binding the book block to produce a printed product. The placing step can include the step of printing or the step of adding a label to either the disk or the sheet of material. The depositing step can include the step of positioning the disk over the personalized indicia such that the disk covers the personalized indicia. The placing step can occur either before or after the depositing step.

DETAILED DESCRIPTION

Figure 1:
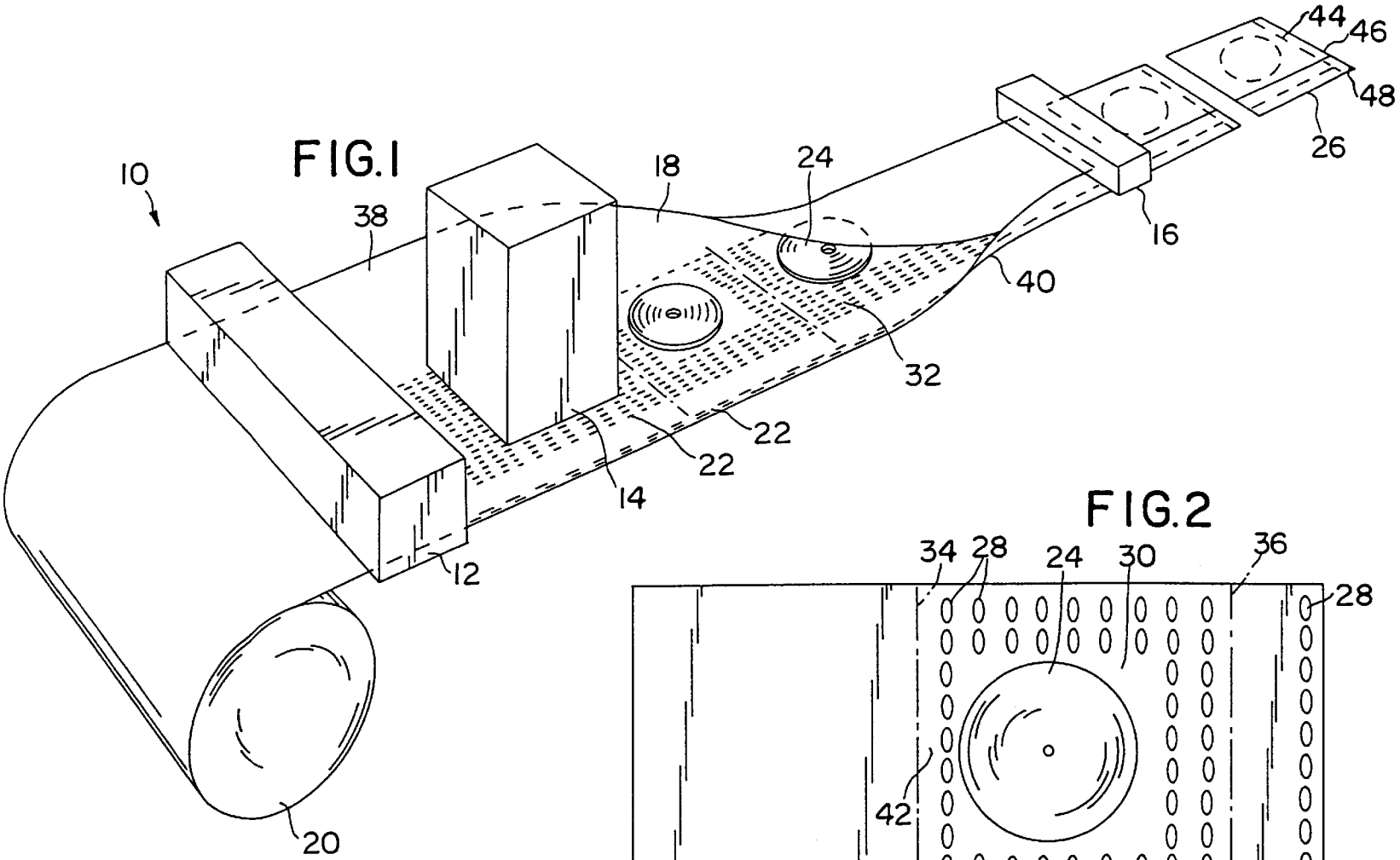
FIG. 1 is a schematic perspective view of an apparatus that could be used to practice the present invention.

FIG. 1 schematically illustrates a paper wrapper 10 having a pattern glue unit 12, a product feeder 14 and a cutter mechanism 16. Briefly, the paper wrapper 10 feeds a web 18 of paper from a roll 20 and toward the glue unit 12. Glue 22 is selectively deposited in a predetermined pattern on the web 18. Products 24 are successively fed from the product feeder 14 and onto the web 18 in spaced relation. Preferably, the products 24 are fed onto a non-glued portion of the web 18. The paper wrapper 10 then folds the web 18, one side at a time, until the web 18 is completely folded around the deposited product 24. Upon folding, the glued portions of the web 18 hold the web 18 in the folded condition. The folded web 18 is then cut into individual packages 26 by the cutter mechanism 16. Paper wrappers 10 of this type are commonly used to wrap paper (or other sheet material 54, such as plastic) around completed magazines. The paper wrapper 10 could, for example, be an MTR Enveloper available from Buhrs Zaandam of The Netherlands or Buhrs America of Eden Prairie, Minn.

The pattern glue unit 12 is positioned between the roll 20 and the product feeder 14. The glue unit 12 deposits glue 22 in a predetermined pattern onto the web 18. The type of glue used in the present invention can vary depending on the web 18 material and on the desired function. For example, if the web 18 is standard print paper, a hot melt glue could be used, such as product number 34-1123 sold by National Starch and Chemical Company of Chicago, Ill. Alternatively, a releasable glue, such as National Starch and Chemical Company product number 34-1123, could be used to make opening of the package 26 easier. A pattern glue unit 12 capable of performing the above-noted function is available as part of the above-described Buhrs Zaandam paper wrapper 10. If desired, the glue heads (not shown) of the glue unit 12 can be interchanged to customize the size and number of the glue beads.

Figure 2:
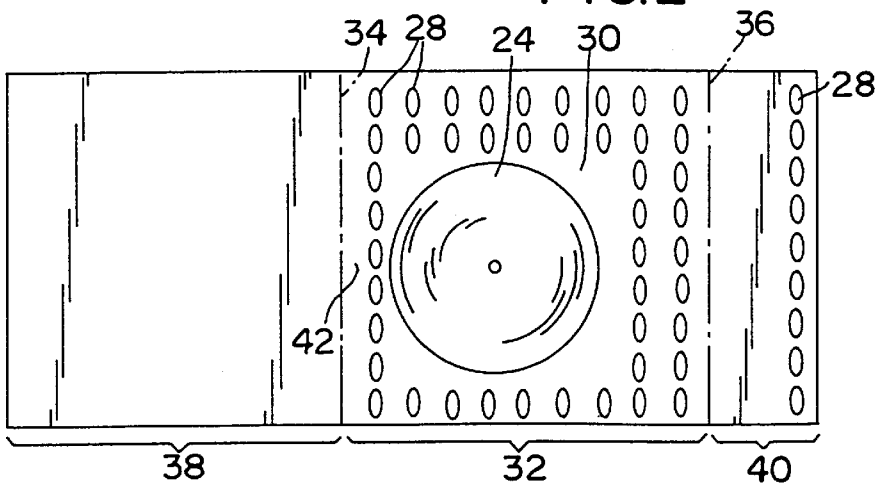
FIG. 2 is a top plan view of a web of material illustrating the relative positioning of adhesive and a computer disk immediately after the computer disk has been deposited onto the web.
Figure 3:
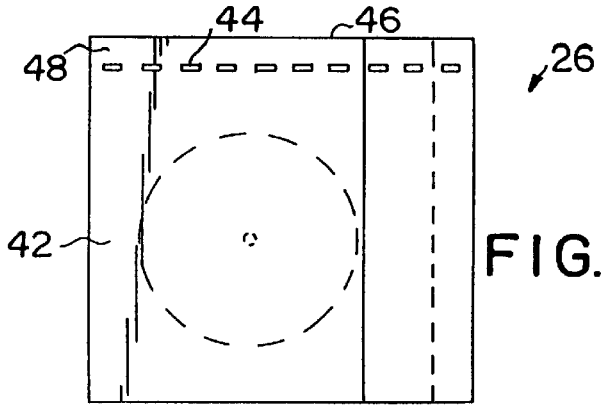
FIG. 3 is a top plan view of a completed packaged computer disk that was produced utilizing the apparatus illustrated in FIG. 1.

The preferred glue pattern is illustrated in FIG. 2, and includes a plurality of small glue beads 28 arranged in such a manner that there is a centrally-located glueless area 30. It should be appreciated that the glue can be applied in any appropriate manner, such as in a bead, stitch, swirl or film. The centrally-located glueless area 30 provides a location for subsequently depositing the product 24. In this manner, no glue will get on the product 24. However, it is noted that the glue beads 28 substantially completely surround the entire perimeter of the glueless area 30, the benefits of which is described below. The glue pattern is generally confined to a middle portion 32 of the web 18 defined by the locations of first and second fold lines 34,36 that illustrate the location that the web 18 will be folded by the paper wrapper 10. The portion of the web 18 to the left of the first fold line will be called the left portion 38, and the portion of the web 18 to the right of the second fold line will be called the right portion 40 (i.e., as viewed in FIG. 2). In addition to the glue in the middle portion 32, glue is also applied to the outer edge of the right portion 40. This glue holds the right portion 40 folded onto the left portion 38 after the folding operation, as described below in more detail.

After glue is deposited onto the web 18, the product feeder 14 deposits a product 24 into the glueless area 30 of the glue pattern. In the illustrated embodiment, the product 24 is a CD-ROM. However, it should be appreciated that the present invention could package other types of products, such as products that have protected opposing surfaces or protected edges. That is, the present invention is particularly applicable to products that have surfaces that could be damaged by gluing, stitching or stapling the product to a signature or card insert in a conventional manner or to products that have edges that could be damaged due to impact. For example, products such as laser disks, phonorecords, computer disks (i.e., CD-ROMs, floppy disks, hard disks, etc.), or any other appropriate product that has protected opposing surfaces could be packaged by the present invention.

The product feeder 14 can be any appropriate apparatus that feeds products 24 (commonly referred to as a "feeder pocket" in the printing industry). For example, a suitable product feeder 14 is called a Pick and Placer, available from Minnesota Automation of Crosby, Minn. Alternatively, instead of feeding directly to the web, the product feeder can feed to a conveyor, and the conveyor can feed to the web.

After depositing the product 24, the left portion 38 of the web 18 is folded by moving the left portion 38 on top of the middle portion 32, thereby covering the entire product 24 and most of the middle portion 32. The fold location, illustrated by the first fold line 34, is intentionally spaced from the product 24, thereby defining a gap 42 between the fold location and the product 24. In addition, the glue pattern is positioned so that a portion of the glue is within the gap 42. In this manner, the left and middle portions of the web 18 will be secured together in the gap 42, thereby forming a secured gap 42 and preventing the product 24 from coming into contact with the fold location. Such a design is beneficial in that it protects the disk from damage in the event that the package 26 is dropped onto a hard surface. That is, if there was no secured gap between the product 24 and the fold location, and if the package 26 was dropped on that folded edge, the product 24 could be severely impacted and damaged by the hard surface. If, on the other hand, there is a secured gap 42 between the product 24 and the hard surface, the product 24 will be somewhat isolated from the hard surface, and the impact will be less severe.

In addition to providing the above-described secured gap 42 between the product 24 and the fold line, the glue pattern is also designed to provide similar secured gaps between the product 24 and the other sides of the package 26. That is, substantially the entire perimeter of the product 24 is surrounded by a secured gap produced by sealing the left portion 38 to the middle portion 32. This design maintains the product 24 spaced from the edges of the package 26, thereby reducing the likelihood of damage to the product 24 in the event that the package 26 is struck on its edge by a hard surface, as described above.

After the left portion 38 has been folded, the right portion 40 is folded over the middle and left portions. In the illustrated embodiment, the right portion 40 does not extend far enough to cover any part of the product 24. The right portion 40 is secured to the left portion 38 by the glue that was previously applied to the right portion 40 by the pattern glue unit 12.

After the folding operation, the web 18 is cut into separate packages 26. This operation is performed by the cutter mechanism 16 that is available with the above-described paper wrapper 10 from Buhrs Zaandam. The cutter mechanism 16 has been modified so that it also forms a perforation line 44 simultaneously with the cutting operation. The illustrated perforation line 44 is formed adjacent and parallel to the leading edge 46 of each package 26. The edge portion 48 of each package 26 between the perforation line 44 and the leading edge 46 is designed to be secured to a printed publication, such as a periodical, catalog or magazine. In this regard, the perforation line 44 facilitates removal of the packages 26 from the printed publication (i.e., by tearing at the perforation line 44).

The width of the edge portion 48 between the perforation line 44 and the leading edge 46 can vary depending on the desired subsequent used of the package 26. For example, if the package 26 will be incorporated into a saddle-stitched publication, a wider edge portion 48 (e.g., about three to four inches wider) will be needed to provide a place to form a fold that will act as the binding during the saddle stitching operation. If, on the other hand, the package 26 will be placed in a perfectly bound publication, then the edge portion 48 can be relatively narrow (e.g., as illustrated), since no fold is required. In the illustrated embodiment, the width of the edge portion 48 (i.e., the distance between the perforation line 44 and the leading edge 46) is about 0.5 inches (12.7 mm).

Figure 4:
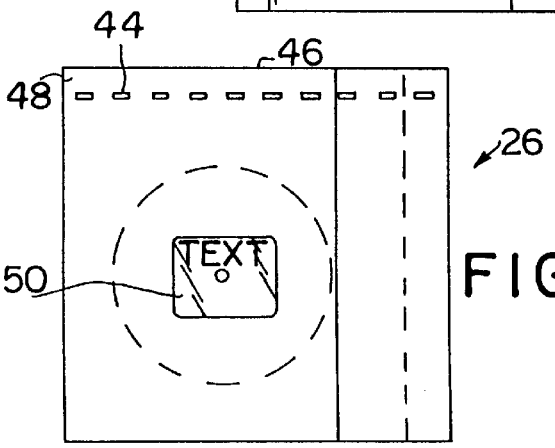
FIG. 4 is a top plan view of a web of material depicting an alternative embodiment of the present invention prior to depositing the computer disk.
Figure 5:
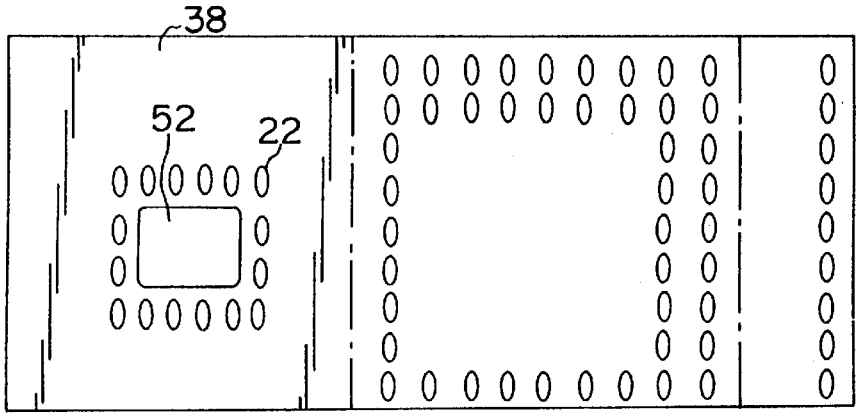
FIG. 5 is a top plan view of the web shown in FIG. 4 after the computer disk and transparent material have been deposited.
Figure 6:
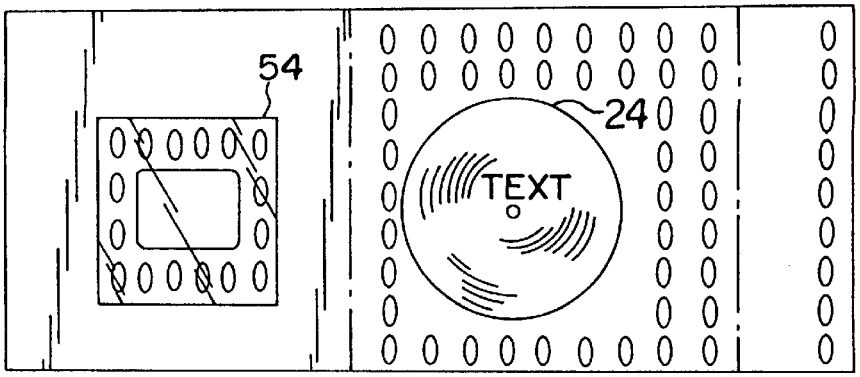
FIG. 6 illustrates a magazine with the packaged disk shown in FIG. 3 incorporated therein.

In an alternative embodiment illustrated in FIG. 4, the packaged disk includes a transparent window 50 that allows text or other indicia on the product 24 to be viewed from the exterior of the package 26, thereby allowing identification of the product 24 without opening 52 of the package 26. Referring to FIGS. 5–6, the transparent window 50 is produced by forming (e.g., cutting) an opening 52 in the web in the area where the transparent window 50 is desired. In the illustrated embodiment, the opening 52 is formed in the center of the left portion 38 (FIG. 5) utilizing an appropriate cutting device. Formation of the window 50 can occur before or after the pattern glue operation, but preferably occurs before to avoid getting glue on the cutting blades. The pattern glue operation deposits glue 22 around the opening 52, in addition to the above-described glue locations. The glue 22 around the opening 52 facilitates securement of transparent material 54 over the opening 52, as shown in FIG. 6. The transparent material 54 can be deposited at the same time as the product 24, if desired, but could also be deposited at any time after the glue operation and before the folding operation. Instead of using glue on the web, the transparent material 54 can be provided with adhesive ahead of time.

The web can also be provided with printing on the side that forms the exterior of the package. For example, printing can be provided on the exterior side of the left portion so that the text is visible to the consumer. The printing can be text and/or designs that provide aesthetic and/or identification functions. For example, the printing could be text that identifies the product. Such printing can be performed before, during or after the packaging operation. Also, the printing can be used with or without the above-described transparent window.

Figure 7:
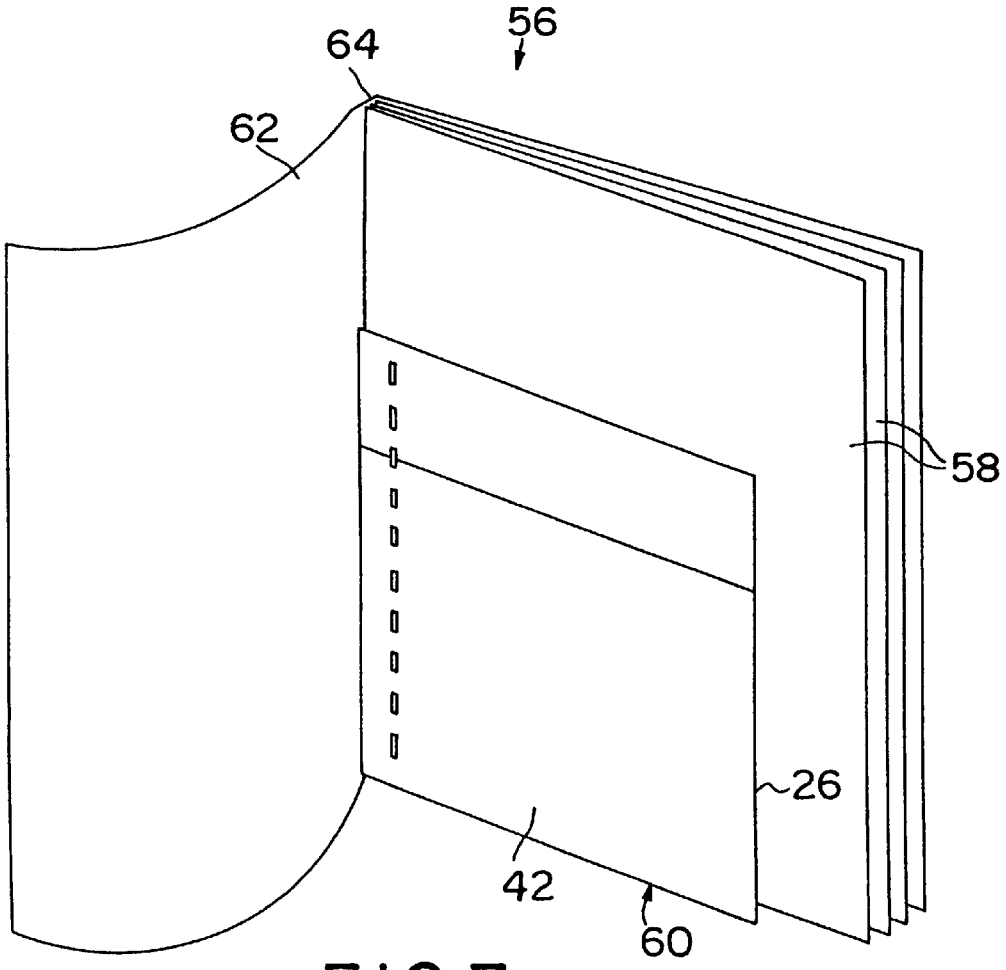
FIG. 7 illustrates the packaged disk of FIG. 3 incorporated into a gathered book.
Figure 8:
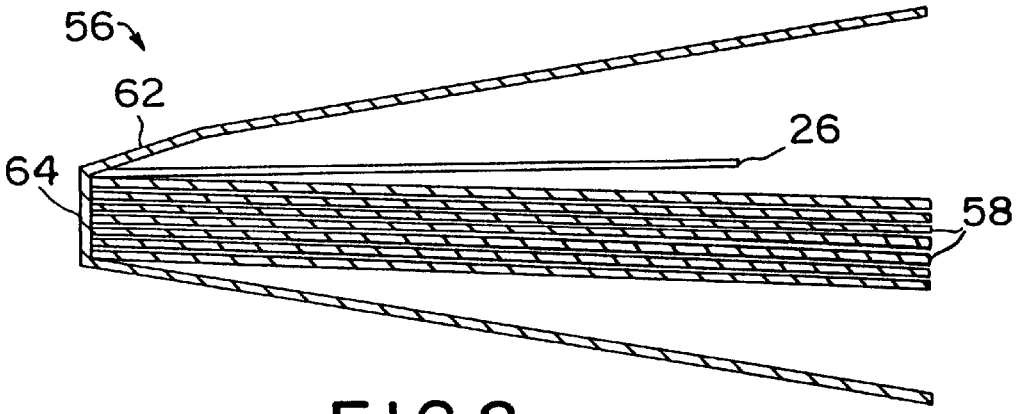
FIG. 8 is a horizontal section view of the gathered book illustrated in FIG. 7.

The above-described designs are specifically designed to be incorporated into a printed publication 56, such as a magazine. The package 26 can be fed into a standard gatherer during the book-forming process. For example, the packaged disk can be fed to a chain-type gatherer, a rotary gatherer, or a pusher-type gatherer with the perforated edge lined up with the binding. During the gathering process, signatures 58 are continually pushed at the foot, thereby forcing the foot of each signature 58, and the foot 60 of the package 26, to be aligned with each other. A cover 62 can then be applied to binding 64 of the gathered signatures, thereby resulting in the perfect-bound gathered book illustrated in FIGS. 7 and 8. In the illustrated embodiment, the foot 60 of the package 26 would correspond with one of the two folded edges. After the gathered book is complete, the book is trimmed/cut along the three non-binding sides. The result is that the foot 60 of the package 26 (which corresponds with a folded edge) will likely be trimmed slightly. The provision of the secured gap 42 between the product and the folded edge facilitates such trimming. That is, without the secured gap 42, the product itself could be trimmed and/or the folded edge could be trimmed, thereby allowing the product to fall out of the package 26.

Figures 9, 10:
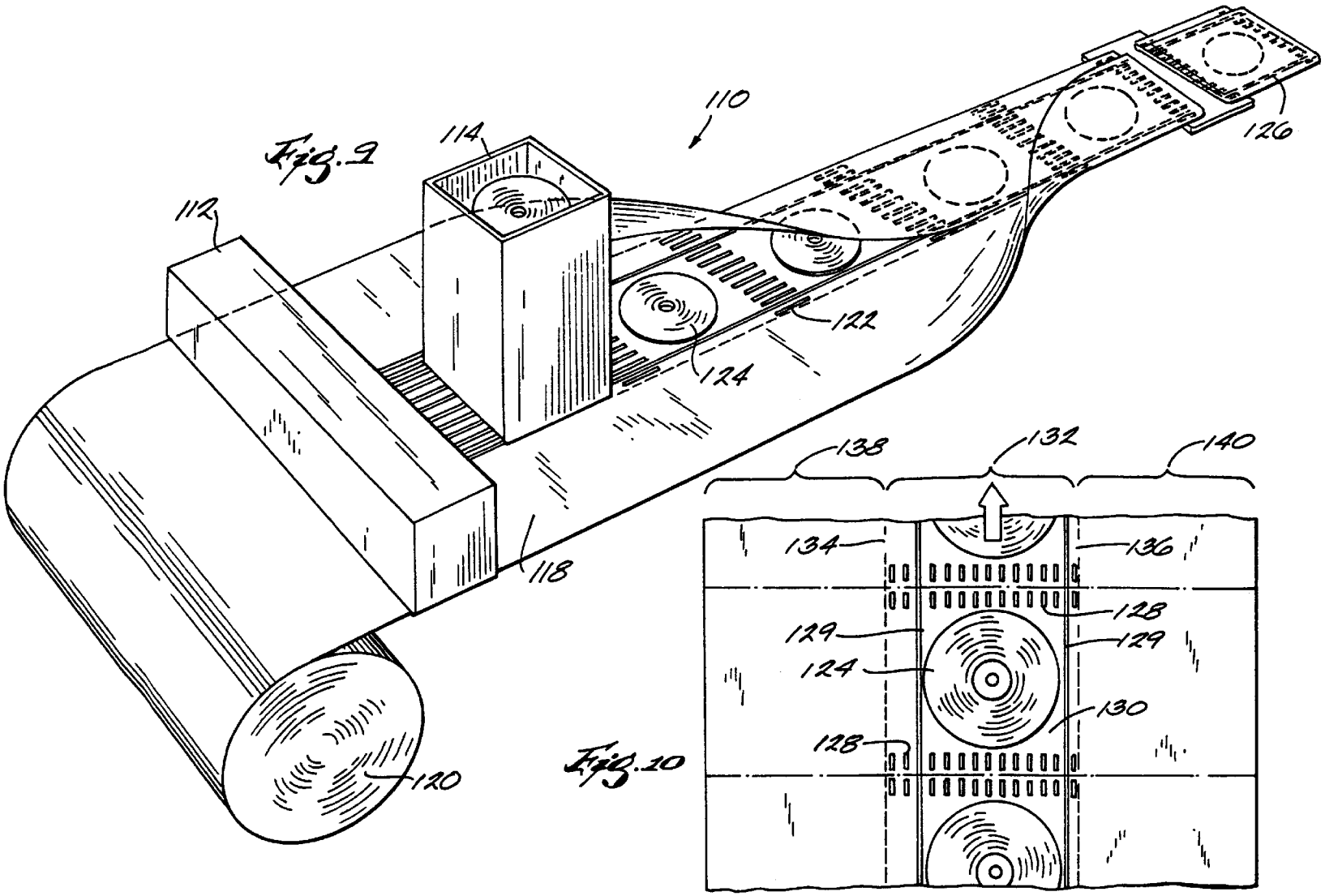
FIG. 9 is a schematic perspective view of an alternative apparatus that could be used to practice the present invention.
FIG. 10 is a top plan view of a web of material illustrating the relative positioning of adhesive and a computer disk immediately after the computer disk has been deposited onto the web in accordance with the embodiment of FIG. 9.

FIGS. 9 and 10 schematically illustrate an alternative embodiment of the present invention. FIG. 9 illustrates a paper wrapper 110 having a pattern glue unit 112, and a product feeder 114. As with the embodiment of FIG. 1, the paper wrapper 110 feeds a web 118 of paper from a roll 120 and toward the glue unit 112. Glue 122 is selectively deposited in a predetermined pattern on the web 118. Products 124 are successively fed from the product feeder 114 and onto the web 118 in spaced relation. Preferably, the products 124 are fed onto a non-glued portion of the web 118. The paper wrapper 110 then folds the web 118, one panel at a time, until the web 118 is completely folded around the deposited product 124. Upon folding, the glued portions of the web 118 hold the left portion in the folded condition. The right portion is folded but is not secured to the glued portions. The folded web 18 is then cut into individual packages 126 by a cutter mechanism (not shown in FIG. 9). Specifics regarding the wrapper 110, the glue unit and the product feeder are set forth above in describing the embodiment of FIG. 1.

The corresponding glue pattern is illustrated in FIG. 10, and includes a plurality of short glue beads 128 and long glue beads 129 arranged in such a manner that there is a centrally-located glueless area 130. The centrally-located glueless area 130 provides a location for subsequently depositing the product 124. In this manner, no glue will get on the product 124. However, it is noted that the glue beads 128,129 substantially completely surround the entire perimeter of the glueless area 130. The glue pattern is generally confined to a middle portion 132 of the web 118 defined by the locations of first and second fold lines 134,136 that illustrate the location that the web 118 will be folded by the paper wrapper 110. The portion of the web 118 to the left of the first fold line 134 will be called the left portion 138, and the portion of the web 118 to the right of the second fold line will be called the right portion 140 (i.e., as viewed in FIG. 10).

After the completed package 126 has been created, it can be incorporated into a printed product, such as a magazine. More specifically, a stack of packages 126 can be positioned into a signature feeder on a binding line. The packages 126 can be oriented such that, when fed onto a gathering chain (i.e., binding vane), the right portion 140 will be placed on one side of the chain and the left portion 138 will be placed on the other side of the chain. In this manner, the package 126 will be supported on the chain so that standard gathering and binding operations can be performed. A signature feeder is disclosed in U.S. Pat. No. 5,100,116, which is incorporated herein by reference in its entirety.

Figure 11:
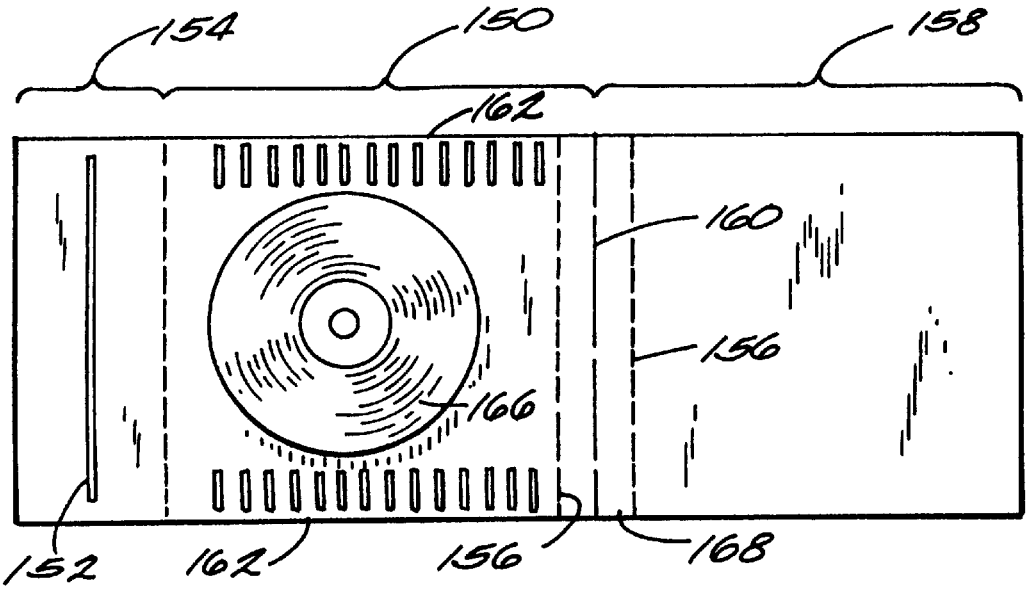
FIG. 11 is top plan view of another embodiment of the present invention.

FIG. 11 illustrates another alternative design. The illustrated design is similar to the one illustrated in FIG. 10, except that no long glue beads are provided in the middle portion 150, and a glue bead 152 is provided on the left portion 154. In addition, perforations 156 are formed in the middle portion 150 and right portion 158, an equal distance on either side of one of the fold lines 160. The perforations 156 are formed before the folding operation. In this manner, the perforations 156 will be substantially aligned with each other after the folding operation.

The package of FIG. 11 is produced by folding the right portion 158 over the middle portion 150, and the left portion 154 over the right portion 158. Both the left portion 154 and the right portion 158 are held down by glue.

Figure 12:
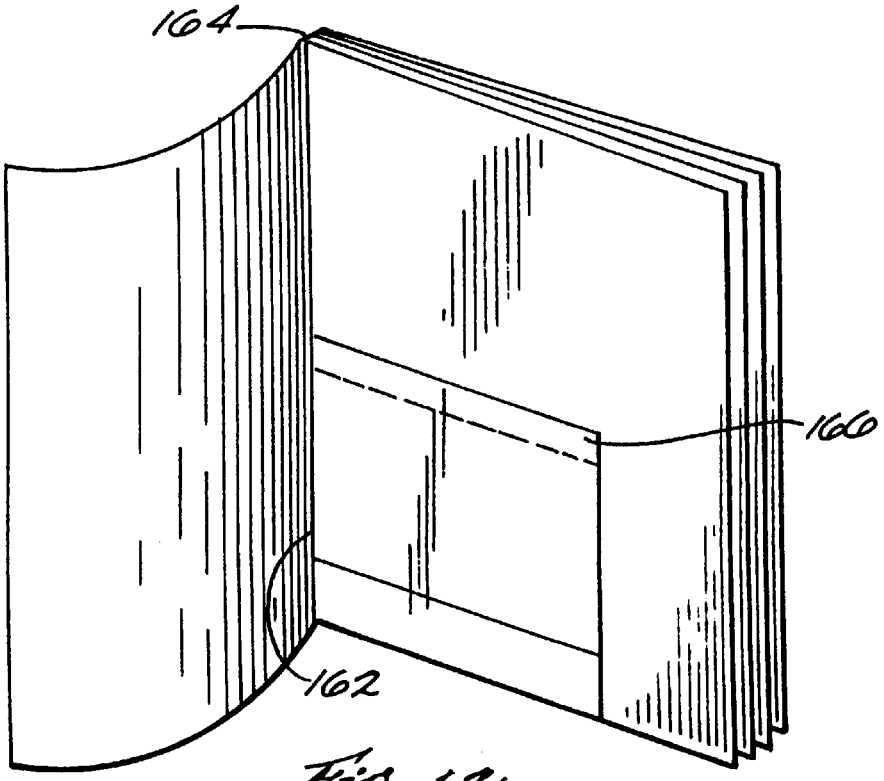
FIG. 12 illustrates a book block having the packaged compact disk of FIG. 11 incorporated therein.

The resulting package can be utilized in a perfect binding procedure with one of the glued edges 162 used as the binding edge 164 (see FIG. 12). With the perforations in the illustrated fashion, the disk 164 can be easily removed from the package. Furthermore, the tear-away strip 166 will stay secured in the printed publication even after the disk is removed.

If desired, the packaged disk can be provided with personalization in the form of the recipient's name, a message, graphics, an access code or other suitable indicia. This can be done, for example, using ink jet printers positioned to print at desired locations. If personalization is desired on the disk, then the printer can be positioned at the product feeder to print on the disk immediately before it is deposited onto the web, or above the web to print on the disk after the disk has been deposited onto the web. The printing can also occur on the web before the disk is deposited and at the location where the disk will be deposited. In this manner, the personalization will be hidden by the disk. Printing on the web is advantageous in that, if an error requires scrapping of a group of packaged disks, the disks can be salvaged and re-used since they are not personalized. Instead of printing, the personalization can occur by adding or securing a label (e.g., a sticker or some other personalized indicia) to the packaged disk. Personalization of printed materials using ink jet printing is disclosed in U.S. Pat. Nos. 5,029,830 and 5,100,116.

In order to simplify the process, the apparatus that produces the packaged disks should be incorporated into the gathering and binding apparatus. More specifically, if personalization will be added to the packaged disks while they are being produced, then it is important to maintain their order relative to the binding apparatus so that each personalized packaged disk will be matched up with the appropriate signatures to form a printed publication. This can be accomplished by positioning the output of the packaging apparatus to feed to the input of a pocket feeder (or other appropriate machine) on the gathering and binding apparatus. In this manner, the packaging apparatus will be integrated into the gathering and binding apparatus, and will continuously feed packaged and personalized disks to the gathering and binding apparatus. That is, the packaged disks may be fed continuously in their packaged order on a conveyor in a separated or imbricated stream, but the disks are not removed and taken out of order between the packaging and gathering steps.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A method of producing a printed product having a computer disk incorporated therein, said method comprising the steps of:

providing a sheet of material;

placing personalized indicia onto the sheet of material;

depositing the disk onto the sheet of material;

folding the sheet of material over the disk to produce a package;

gathering the package with a signature to produce a book block; and binding the book block to produce a printed product.

2. A method as claimed in claim 1, wherein said placing step includes the step of printing onto the sheet of material.

3. A method as claimed in claim 1, wherein said placing step includes the step of adding a label to the sheet of material.

4. A method as claimed in claim 1, wherein said depositing step includes the step of positioning the disk over the personalized indicia such that the disk covers the personalized indicia.

5. A method as claimed in claim 1, wherein said placing step occurs before said depositing step.

6. A method as claimed in claim 1, wherein said placing step occurs after said depositing step.

7. A method as claimed in claim 1, further comprising the step of continuously conveying successive packages from the folding step to the gathering step.

8. A method of producing a printed product having a computer disk incorporated therein, said method comprising the steps of:

providing a sheet of material;

placing personalized indicia onto the disk;

depositing the disk onto the sheet of material;

folding the sheet of material over the disk to produce a package;

gathering the package with a signature to produce a book block; and binding the book block to produce a printed product.

9. A method as claimed in claim 8, wherein said placing step includes the step of printing onto the disk.

10. A method as claimed in claim 8, wherein said placing step includes the step of adding a label to the disk.

11. A method as claimed in claim 8, wherein said depositing step includes the step of positioning the disk over the personalized indicia such that the disk covers the personalized indicia.

12. A method as claimed in claim 8, wherein said placing step occurs before said depositing step.

13. A method as claimed in claim 8, wherein said placing step occurs after said depositing step.

14. A method as claimed in claim 8, further comprising the step of continuously conveying successive packages from the folding step to the gathering step.

15. A method of producing a packaged computer disk comprising the steps of:

providing a sheet of material;

placing personalized indicia onto the sheet of material;

depositing the disk onto the sheet of material such that the disk is positioned over the personalized indicia; and folding the sheet of material over the disk to produce a packaged disk.

16. A method as claimed in claim 15, wherein said placing step includes the step of printing onto the sheet of material.

17. A method as claimed in claim 15, wherein said placing step includes the step of adding a label to the sheet of material.

18. A method as claimed in claim 15, wherein said placing step occurs after said depositing step.

19. A method as claimed in claim 15, wherein said placing step occurs before said depositing step.

20. A method of producing a packaged computer disk comprising the steps of:

providing a sheet of material;

placing personalized indicia onto the disk;

depositing the disk onto the sheet of material; and folding the sheet of material over the disk to produce a packaged disk.

21. A method as claimed in claim 20, wherein said depositing step includes the step of positioning the disk over the personalized indicia such that the disk covers the personalized indicia.

22. A method as claimed in claim 20, wherein said placing step occurs before said depositing step.

23. A method as claimed in claim 20, wherein said placing step occurs after said depositing step.

24. A method as claimed in claim 20, wherein said placing step includes the step of printing onto the disk.

25. A method as claimed in claim 20, wherein said placing step includes the step of adding a label to the disk.

* * * * *